US010105567B1

(12) United States Patent
Miller

(10) Patent No.: US 10,105,567 B1
(45) Date of Patent: Oct. 23, 2018

(54) ARC CENTER DRIVE ELLIPTICAL EXERCISE DEVICE

(71) Applicant: Larry D. Miller Trust, Rochester, MI (US)

(72) Inventor: Larry D. Miller, Rochester, MI (US)

(73) Assignee: Larry D. Miller Trust, Rochester, MI (US), Trust ( * ) Notice: Subject to any disclaimer, the term of this patent is extended or adjusted under 35 U.S.C. 154(b) by 0 days.

(21) Appl. No.: 15/663,111

(22) Filed: Jul. 28, 2017

Related U.S. Application Data

(60) Provisional application No. 62/512,863, filed on May 31, 2017, provisional application No. 62/489,009, filed on Apr. 24, 2017.

(51) Int. Cl.
*A63B 22/00* (2006.01)
*A63B 22/02* (2006.01)
*A63B 22/20* (2006.01)

(52) U.S. Cl.
CPC ..... *A63B 22/001* (2013.01); *A63B 22/0023* (2013.01); *A63B 22/0056* (2013.01); *A63B 22/0285* (2013.01); *A63B 22/208* (2013.01)

(58) Field of Classification Search
None
See application file for complete search history.

(56) References Cited

U.S. PATENT DOCUMENTS 5,947,872 A * 9/1999 Ryan ..... A63B 22/001 482/51
6,024,676 A 2/2000 Eschenbach
6,168,552 B1 * 1/2001 Eschenbach ..... A63B 22/001 482/51
7,169,088 B2 * 1/2007 Rodgers, Jr. ..... A63B 22/001 482/52
7,244,217 B2 * 7/2007 Rodgers, Jr. ..... A63B 22/001 482/52
7,316,632 B2 1/2008 Rodgers, Jr.
7,517,303 B2 * 4/2009 Crawford ..... A63B 21/154 482/52
7,651,446 B1 * 1/2010 Eschenbach ..... A63B 22/001 482/140
7,749,137 B2 7/2010 Watt et al.
7,887,465 B2 2/2011 Uffelman
7,922,625 B2 4/2011 Grind
9,017,223 B2 * 4/2015 Eschenbach ..... A63B 21/00069 482/52
9,468,797 B1 * 10/2016 Miller ..... A63B 22/001
9,649,529 B1 * 5/2017 Miller ..... A63B 22/0664
2003/0027690 A1 * 2/2003 Miller ..... A63B 22/001 482/51
2009/0111663 A1 * 4/2009 Kuo ..... A63B 22/001 482/53
2015/0352402 A1 12/2015 Arnold et al.
2016/0089562 A1 * 3/2016 Grossmann ..... A63B 21/4047 482/52

* cited by examiner

*Primary Examiner* — Stephen R Crow
(74) *Attorney, Agent, or Firm* — Dinsmore & Shohl LLP

(57) ABSTRACT

An exercise device has a frame supporting guide links to which foot support links are pivotally attached. An arc center drive assembly is provided to raise and lower the foot receiving areas of the foot support links. Vertical drive elements couple a crank system to the arc center drive assembly to control the raising and lowering of the foot receiving areas.

21 Claims, 5 Drawing Sheets

ARC CENTER DRIVE ELLIPTICAL EXERCISE DEVICE

REFERENCE TO RELATED APPLICATIONS

This application claims priority to U.S. Provisional Application Ser. No. 62/489,009, filed Apr. 24, 2017 and 62/512,863, filed May 31, 2017. The entire content of each application is incorporated herein by reference.

FIELD OF THE INVENTION

This invention relates generally to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links is pivotally supported on a frame and a foot engaging link is supported at the lower end of each guide link. An intermediate link connects each guide link to A crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible control member engages each foot link and extends up and over a pulley located at the guide link pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

U.S. Pat. No. 8,979,714 to Miller discloses an elliptical exercise device having a frame supporting guide links which provide for horizontal motion of associated foot support links. A mechanical coupling couples the foot support links to the crank system and intermediate links connect the crank system to the guide links such that a foot receiving area of each foot support link moves in an elliptical path when the crank system rotates.

U.S. Pat. No. 9,192,809 to Miller et al. discloses an elliptical exercise device with a frame supporting guide links and foot support links. Upper pulleys are pivotally connected to the frame or guide links, front lower pulleys are connected to the guide links or foot support links and rear lower pulleys are connected to the foot support links. A flexible element extends from a vertical drive assembly to the upper pulley, front lower pulley, rear lower pulley and then to the frame rearward of the guide link pivot.

Additional exercise devices will be known to those of skill in the art.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an exercise device has a frame configured to be supported on a horizontal surface, the frame having a first pivot axis defined thereon. A first and a second guide link each have a first and a second attachment point defined thereon, with each guide link being pivotally attached, through its first attachment point, to the frame at the first pivot axis thereof. A first and a second foot support link each have a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. An arc center drive assembly is operable to raise and lower the foot receiving areas of the foot support links, the arc center drive assembly having a first and a second lift arm each having a pivot end pivotally connected to the lower portion of the frame and an opposite lift end, the lift end engaging a surface of a respective one of the foot support links such that pivoting of the lift arm causes the foot receiving area of the respective foot support link to raise or lower. A crank is supported on the frame for rotation about a crank axis. A first and a second vertical drive element each extend generally rearwardly from a first end coupled to the crank to a second end coupled to a respective one of the lift arms such that rotation of the crank about the crank axis is operable via the vertical drive elements to pivot the lift arms about their respective pivot ends and to thereby raise and lower the foot receiving areas of the foot support links. The lift arms each pivot through less than 180 degrees.

In some versions, the vertical drive elements are in tension in all rotational positions of the crank. The vertical drive elements may each be a rigid link. Alternatively, the vertical drive elements are each a flexible element, the flexible elements being cables or belts. The elliptical exercise device may include a first and a second forward pulley pivotally supported on the frame forward of the crank axis, with the flexible elements each extending around a respective one of the forward pulleys.

In some versions, the vertical drive elements are generally horizontal.

The arc center drive assembly may also include a first and a second lift lever, each lift lever being interconnected with a respective one of the lift arms such that movement of the lift levers causes pivotal movement of the corresponding lift arm, the second ends of the vertical drive elements each being coupled to the respective lift arm by being coupled to the corresponding lift lever.

In some versions, the lift end of each lift arm extends generally rearwardly and upwardly from its pivot end when at an upper end of its range of travel. Each lift arm may be generally horizontal when at a lower end of its range of travel and each lift arm may pivot through less than 90 degrees.

In some versions, the surface of each of the foot support links that is engaged by the lift end of the respective lift arm is a lower surface, the lower surface being angled or curved downwardly away from a foot receiving surface of the foot receiving area of the respective foot support link.

Some versions may further include a first and a second horizontal drive element each having a first end coupled to the crank and a second end coupled to a respective one of the guide links such that rotation of the crank about the crank axis is operable via the horizontal drive elements to pivot the guide links relative to the frame and to thereby cause the foot receiving areas to move in a path of travel having a horizontal component of motion.

Another embodiment of an elliptical exercise device has a frame with an upper portion and a lower portion, the lower portion configured to be supported on a horizontal surface, the frame having a first pivot axis defined thereon. A first and a second guide link each have a first and a second attachment point defined thereon, each guide link being pivotally attached, through its first attachment point, to the frame at the first pivot axis thereof. A first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. An arc center drive assembly is operable to raise and lower the foot receiving areas of the foot support links. The arc center drive assembly has a first and a second lift arm each having a pivot end pivotally connected to the lower portion of the frame and an opposite lift end, the lift end engaging a surface of a respective one of the foot support links such that pivoting of the lift arm causes the foot receiving area of the respective foot support link to raise or lower. A crank is supported on the frame for rotation about a crank axis. A first and a second vertical drive element each having a first end coupled to the crank and a second end coupled to a respective one of the lift arms such that rotation of the crank about the crank axis is operable via the vertical drive elements to pivot the lift arms about their respective pivot ends and to thereby raise and lower the foot receiving areas of the foot support links. A first and a second horizontal drive element each has a first end coupled to the crank and a second end coupled to a respective one of the guide links such that rotation of the crank about the crank axis is operable via the horizontal drive elements to pivot the guide links relative to the frame and to thereby cause the foot receiving areas to move in a path of travel having a horizontal component of motion. The lift anus each pivot through less than 180 degrees.

In some versions, the vertical drive elements are generally horizontal.

The arc center drive assembly may also include a first and a second lift lever, each lift lever being interconnected with a respective one of the lift arms such that movement of the lift levers causes pivotal movement of the corresponding lift arm, the second ends of the vertical drive elements each being coupled to the respective lift arm by being coupled to the corresponding lift lever.

In some versions, the lift end of each lift arm extends generally rearwardly and upwardly from its pivot end when at an upper end of its range of travel. Each lift arm may be generally horizontal when at a lower end of its range of travel and each lift arm may pivot through less than 90 degrees.

In some versions, the surface of each of the foot support links that is engaged by the lift end of the respective lift arm is a lower surface, the lower surface being angled or curved downwardly away from a foot receiving surface of the foot receiving area of the respective foot support link.

DETAILED DESCRIPTION OF THE INVENTION

Figure 1:
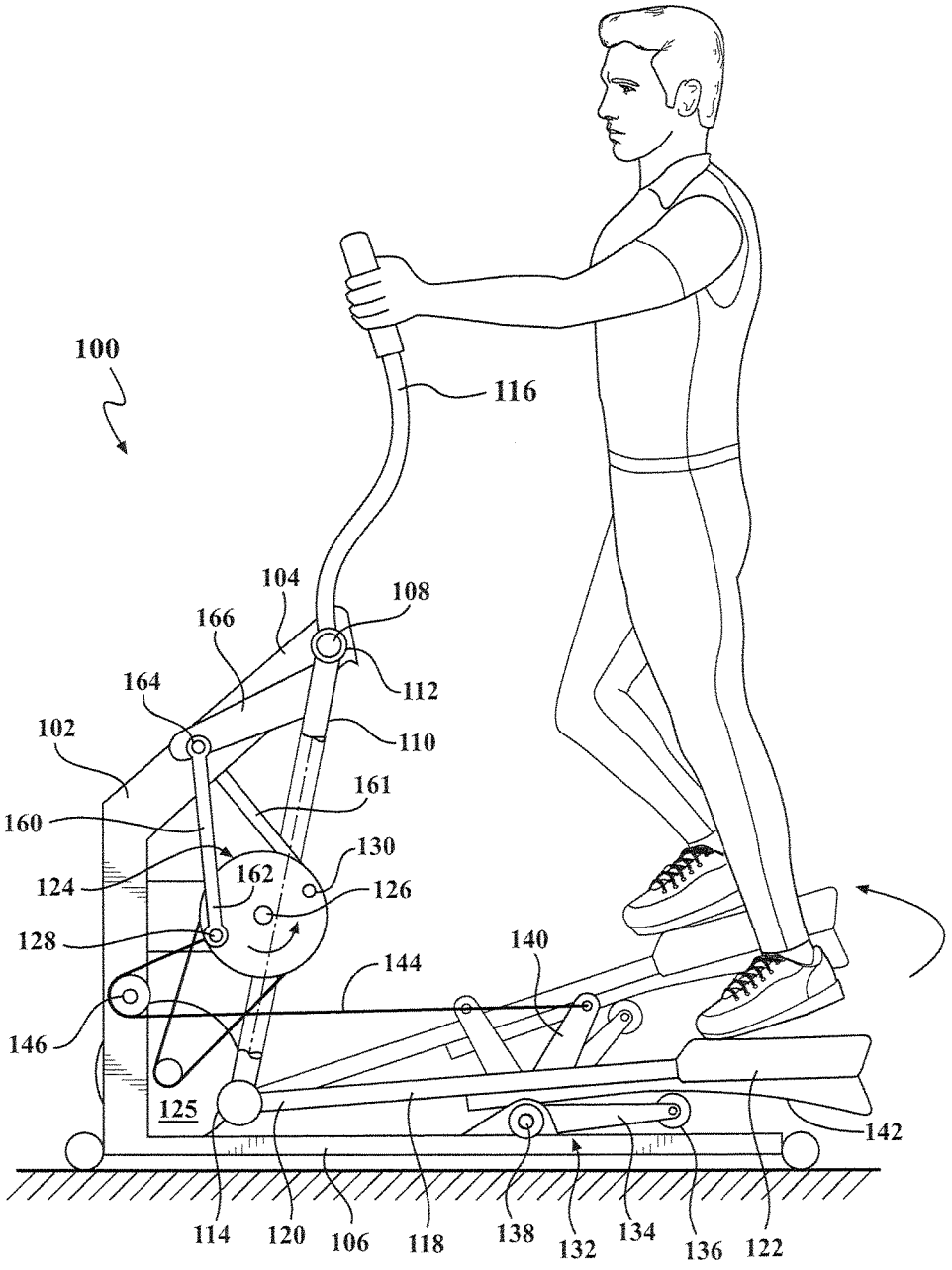
FIG. 1 is a side elevational view of an embodiment of an elliptical exercise device in accordance with the present invention.

The present invention will be explained with reference to a particular embodiment, including optional features of this embodiment. It is to be understood that other embodiments, modifications, and variations thereof will be apparent to those of skill in the art in view of the teaching presented herein.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention make use of a crank system to control the horizontal and/or vertical motions of the foot receiving areas of the exercise device.

FIG. 1 is a side view showing the basic layout of a fixed-path version of an elliptical exercise device 100. The illustrated device 100 includes a frame 102 which is configured and operative to contain and/or support the various other components of the device on a horizontal surface such as a floor. The frame 102 may take a variety of the shapes and forms, as long as it provides support for the components of the device. The frame 102 has an upper portion 104 and a lower portion 106. The lower portion 106 is configured to contact the horizontal surface while the upper portion 104 supports portions of the device. A first pivot axis 108 is defined in the upper portion 104 of the frame 102. The frame 102 may be said to have a forward portion forward of the first pivot axis 108, which is to the left in the view of FIG. 1, and a rearward portion rearward of the first pivot axis 108, which is to the right in the view of FIG. 1. In this embodiment, the upper portion 104 generally lacks any rearward portion; the upper portion extends rearwardly only far enough to support the pivot axis 108.

As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 1 shows a side view of the device 100 with the left elements most visible.

A pair of guide links are pivotally interconnected with the frame so as to be pivotable about the first pivot axis 108. The left guide link 110 is shown at the midpoint of its travel with the right guide link hidden behind it. The guide link 110 is partially cut away in FIG. 1 to make other components more visible. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from the first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. A crank system 124 is pivotally interconnected with the frame 102 such that a crank system 124 rotates about a second pivot axis 126 defined on the frame 102. The second pivot axis 126 also serves as the crank axis. In this embodiment, the crank system 124 is forward of the first pivot axis 108 and the second pivot axis 126 is below the first pivot axis 108, though it may be positioned elsewhere in other embodiments. The crank system 124 has a pair of crank connections or arms 128 and 130 that are 180 degrees apart. In the illustrated embodiment, the crank "arms" are defined by a pulley having connection locations defined thereon. In alternative embodiments, the crank may have actual arms extending from the crank axis. The crank system 124 represents one type of drive assembly, which in this case is a combined vertical and horizontal drive assembly. The crank system may include a flywheel such as shown at 125 and any type of resistance device. In the illustrated embodiment, element 125 may also represent a resistance device for resisting rotation of the crank system 124.

An arc center drive assembly 132 acts to raise and lower each foot support link. The center drive assembly has a lift arm 134 with a roller 136 at its rearward end. This rearward end may be considered a lift end 136. The lift arm 134 has an opposite pivot end that is pivotally attached to the lower portion 106 of the frame 102 at a lift axis 138. The center drive assembly further has a lift lever 140 having a lower end connected to the lift arm 134 such that the lift lever 140 and lift arm 134 rotate about the lift axis 138 together. A lift track 142 is defined on the underside of the foot support link 118 and this lift track engages the roller 136 at the lift end of the lift arm 134. As such, as the lift arm 134 and lift lever 140 rotate counterclockwise about the lift axis 138, the roller 136 lifts the foot support link upwardly, raising the foot receiving area 122. Rotating the center drive assembly clockwise lowers the foot receiving area.

Vertical drive elements couple the crank system 124 to the lift arms 134. In this embodiment, the vertical drive elements take the form of flexible elements. Flexible vertical drive element 144 has one end coupled to the crank connection 128 of the crank system 124 and an opposite end connected to an upper end of the lift lever 140, thereby coupling the crank system 124 to the lift arm 134. The flexible element may directly extend between the two ends. Alternatively, as in the illustrated embodiment, the flexible element has a mid portion that extends around a forward pulley 146 on the forward portion of the frame 102 forward of and below the crank system 124. As such, the flexible element extends forwardly from the arc center drive assembly and then rearwardly back to the crank system. As the crank system rotates, the flexible element causes the arc center drive assembly to raise and lower the respective foot receiving area 122. In this embodiment, the arc center drive assembly 132 is rearward of the first pivot axis 108 and serves as the only structure that upwardly supports the foot receiving areas.

The center drive assembly 132 is referred to as an "arc" center drive assembly because the lift ends of the lift arms travel in an arc, not in a full circle. It is preferred that the arc and the pivot travel of the arms is each less than 180 degrees. In the illustrated embodiment, the lift arms extend generally horizontally rearwardly at the lower end of their range of travel and extends rearwardly and upwardly at the upper end of their range of travel. They pivot through less than 90 degrees. As will be clear to those of skill in the art, this also means that the flexible vertical drive elements are always in tension. In this embodiment, they also extend generally horizontally from the forward pulley 146 to the arc center drive assembly.

The illustrated embodiment of the exercise device 100 is fixed path device with a horizontal drive assembly driving the guide links such that the foot receiving areas move in a path of travel having a horizontal component of motion. In this embodiment, the horizontal drive assembly is part of the crank system 124. Specifically, the crank system is also a crank for the horizontal drive. A horizontal drive link 160 has a lower 162 end connected to the crank system 124 and an upper end 164 connected to an attachment portion 166 extending forwardly from the guide link 110. As such, as the crank system 124 rotates about the crank axis 126, the horizontal drive link 160 causes the guide link 110 to pivot about the first pivot axis 408. A second horizontal drive link 161 controls the other guide link and is attached to the crank at a position 180 degrees from the first horizontal drive link 460. As shown, in this embodiment, the connection of the horizontal drive links 160 and 161 are the same as the connection of the respective flexible element (only element 144 is shown). That is, the horizontal drive link 160 for controlling horizontal motion of the left foot is connected to the crank at the same location as the flexible element 132 for controlling vertical motion of the left foot.

Figure 2:
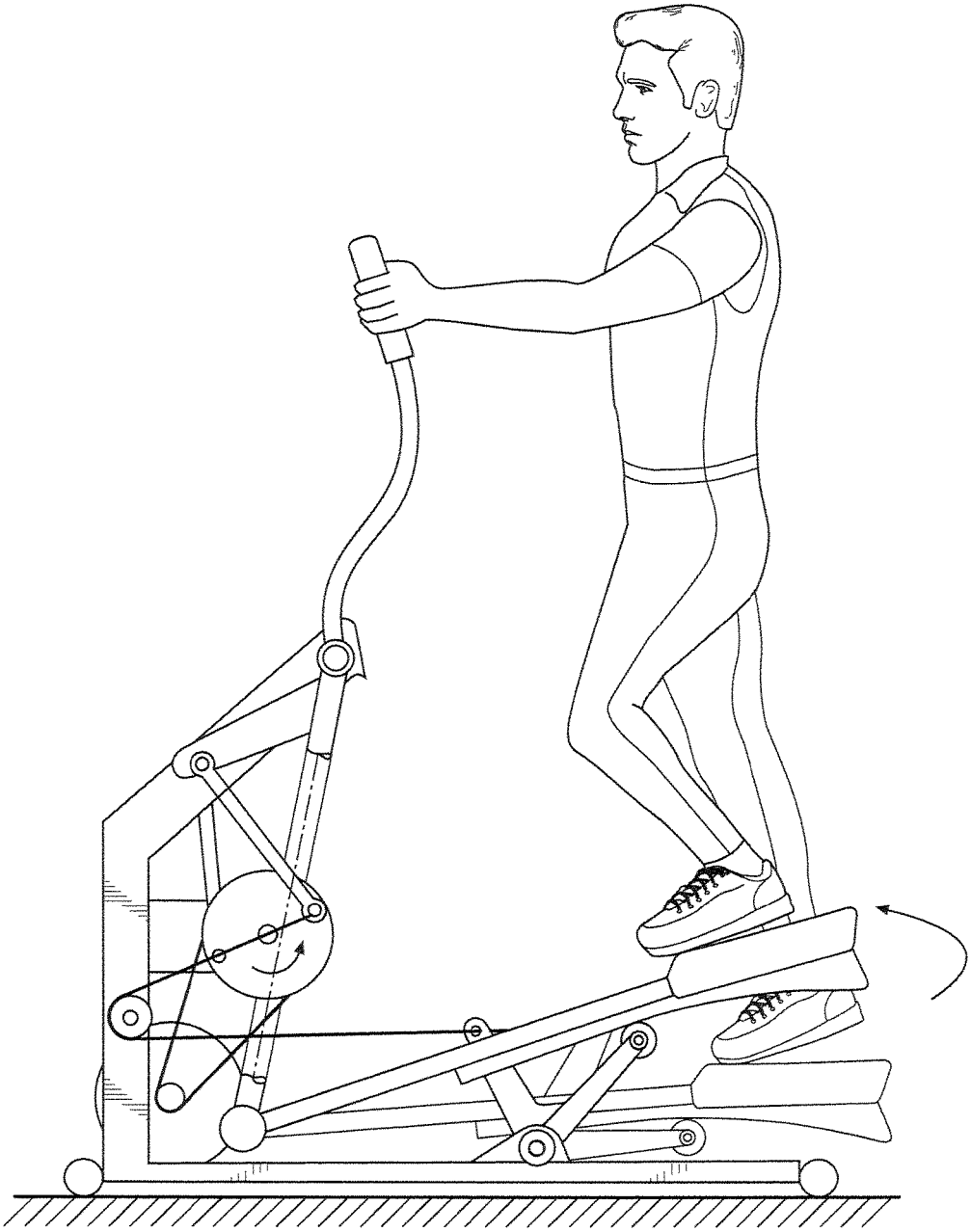
FIG. 2 is a side elevational view of the elliptical exercise device of FIG. 1 with the crank in a different position.

In some embodiments, the connection locations may be different so as to provide a desirable footpath. FIG. 2 shows the exercise device 100 of FIG. 1 with the crank system rotated 180 degrees.

Figure 3:
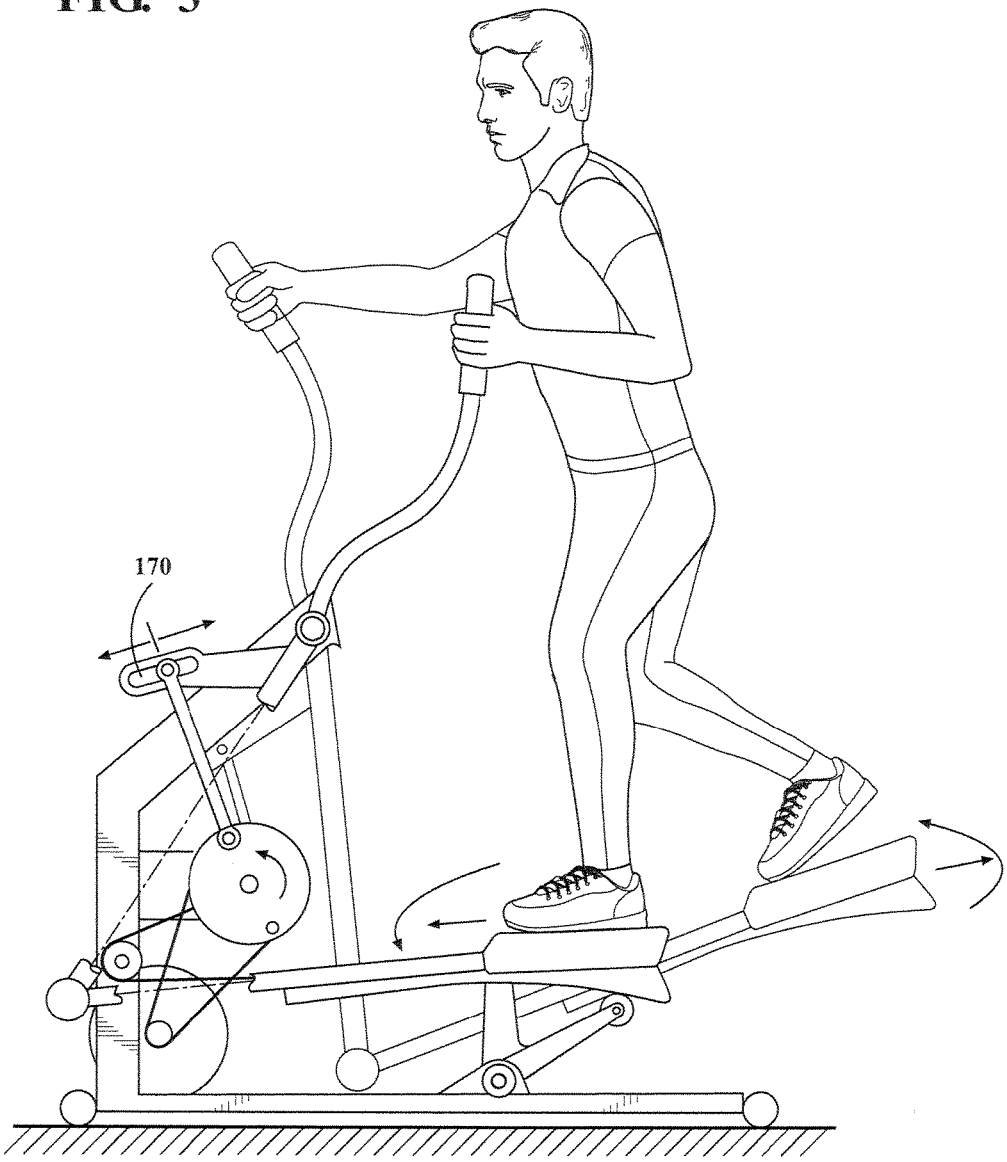
FIG. 3 is a side elevational view of an embodiment of an elliptical exercise device similar to the device of FIG. 1 but with an adjustment for horizontal travel.

To adjust the range of horizontal travel, the attachment points on the attachment portions of the guide links may be adjustable, either manually or by an actuator, so as to change where the horizontal drive links attach. Likewise, the range of vertical travel may be adjusted by changing the position of the roller 136, the mechanical advantage of the center drive assembly or in other ways. FIG. 3 shows an adjustment option for horizontal travel, by providing a slot 170 in the attachment portion 172 of the guide links so that the mechanical advantage of the horizontal drive links may be adjusted. Other options may be used. FIG. 3 also shows the exercise device with the crank pivoted by 90 degrees as compared to FIG. 1, with the foot receiving areas at their respective rearwardmost and forwardmost positions.

The present invention may also provide a free stride elliptical exercise device. In this version, the horizontal drive links 160 and 161 are omitted and the guide links may be interconnected by a coordination mechanism that maintains them at 180 degrees out of phase. Those of skill in the art will be aware of coordination mechanisms for use with such an exercise device.

Figure 4:
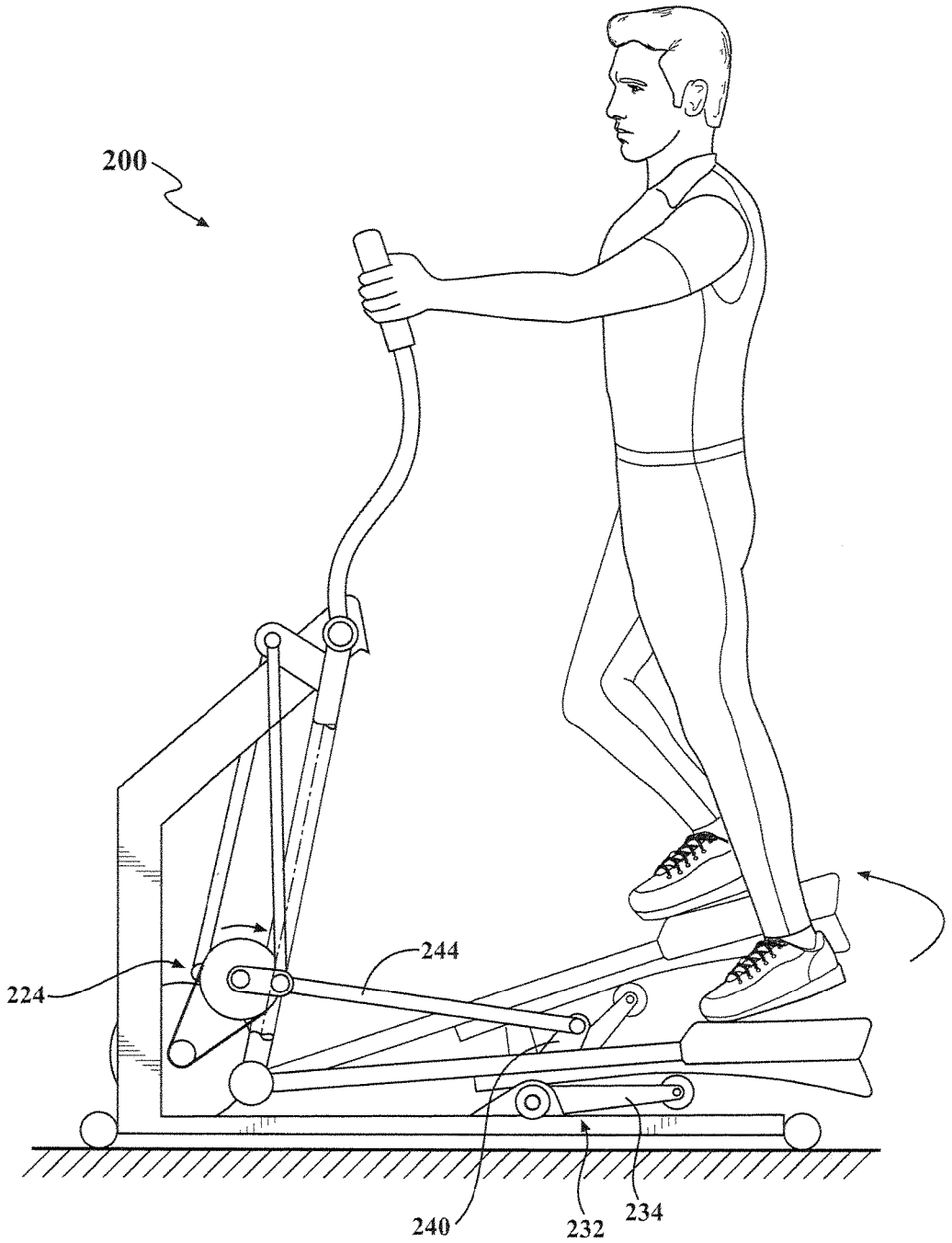
FIG. 4 is a side elevational view of an embodiment of an elliptical exercise device with a rigid vertical drive link.

FIG. 4 shows an alternative embodiment of a fixed path version of an elliptical exercise device 200. It is substantially the same as the earlier embodiment except that a rigid element 244 replaces the flexible element 144 for interconnecting the crank system 224 with the lift lever 240 of the arc center drive assembly 232. Another rigid element, not shown, operates the lift arm for the right foot. Otherwise, the operation and construction is the same as for the earlier embodiment. As a further alternative, the rigid elements 244 may instead be flexible elements such as cables, extending rearwardly from the crank system 224 to the respective lift levers. The design allows the flexible element to always be in tension so a rigid element is not required. With either the rigid or flexible approach, the vertical drive elements may be generally horizontal, as shown. Generally horizontal is defined herein as being within 25 degrees of horizontal, plus or minus.

Figure 5:
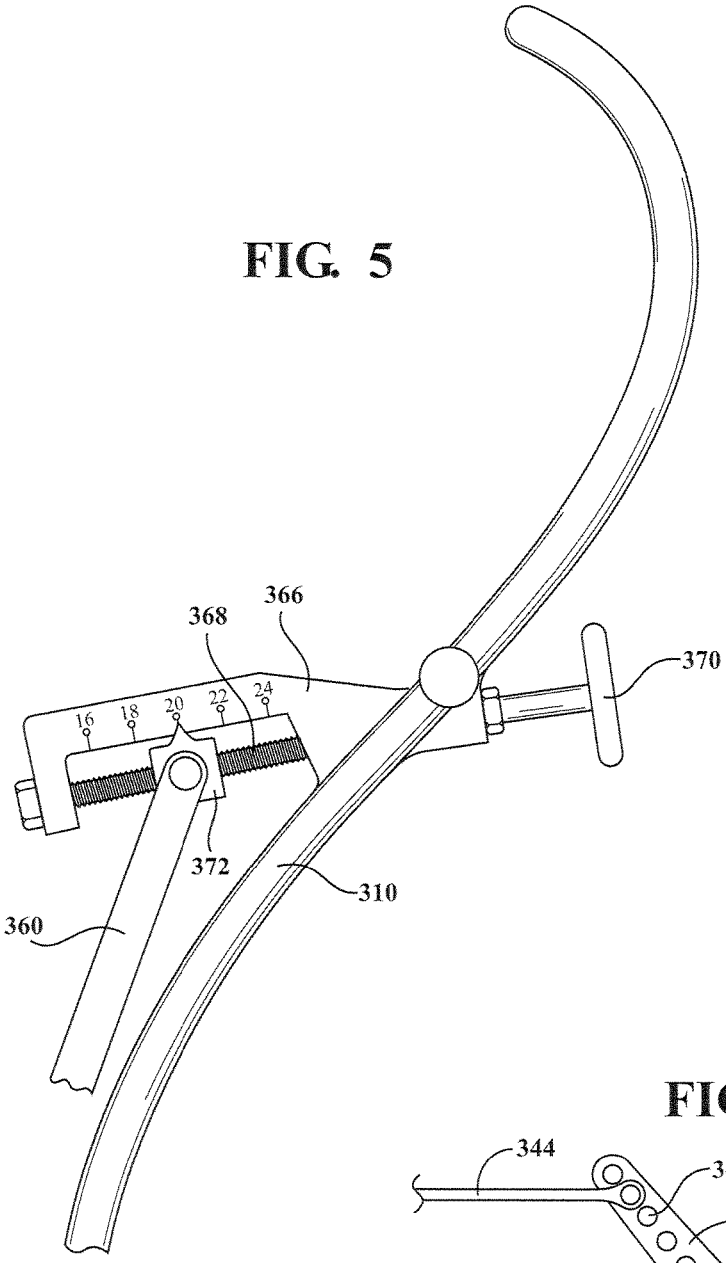
FIG. 5 is a detailed view of an adjustment mechanism for adjusting horizontal travel, which may be used with embodiments of the present invention.
Figure 6:
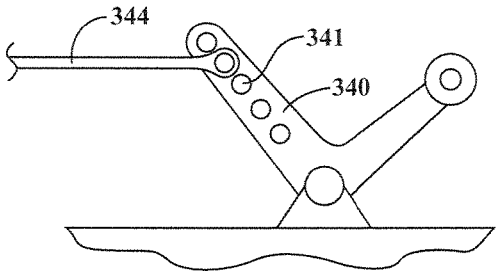
FIG. 6 is a detailed view of an adjustment mechanism for adjusting vertical travel, which may be used with embodiments of the present invention.

FIG. 5 shows an alternative approach to adjusting horizontal travel. An adjustable attachment portion 366 extends from the guide link 310 and has a rotary screw that is turned by handle 370. As the screw rotates, the position of a nut 372 is adjusted relative to the remainder of the guide link. The horizontal drive link 360 is attached to the nut and therefore adjusting the position of the nut adjusts the horizontal travel. FIG. 6 shows an adjustment mechanism for the arc center drive in which a lift lever 340 has multiple attachment holes 341 for connecting the vertical drive element 344.

Further alternatives, which do not depart from the scope or teaching of the present invention, will be clear to those of skill in the art. It is the following claims, including all equivalents, which define the scope of the present invention.

The invention claimed is:

1. An elliptical exercise device, comprising:

a frame having an upper portion and a lower portion, the lower portion configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

an arc center drive assembly operable to raise and lower the foot receiving areas of the foot support links, the arc center drive assembly having a first and a second lift arm each having a pivot end pivotally connected to the lower portion of the frame and an opposite lift end, the lift end engaging a surface of a respective one of the foot support links such that pivoting of the lift arm causes the foot receiving area of the respective foot support link to raise or lower;

a crank supported on the frame for rotation about a crank axis; and a first and a second vertical drive element extending generally rearwardly from a first end coupled to the crank to a second end coupled to a respective one of the lift arms such that rotation of the crank about the crank axis is operable via the vertical drive elements to pivot the lift arms about their respective pivot ends and to thereby raise and lower the foot receiving areas of the foot support links;

wherein the lift arms each pivot through less than 180 degrees.

2. The elliptical exercise device of claim 1, wherein the vertical drive elements are in tension in all rotational positions of the crank.

3. The elliptical exercise device of claim 2, wherein the vertical drive elements are each a rigid link.

4. The elliptical exercise device of claim 2, wherein the vertical drive elements are each a flexible element, the flexible elements being cables or belts.

5. The elliptical exercise device of claim 4, further comprising a first and a second forward pulley pivotally supported on the frame forward of the crank axis, the flexible elements each extending around a respective one of the forward pulleys.

6. The elliptical exercise device of claim 1, wherein the vertical drive elements are generally horizontal.

7. The elliptical exercise device of claim 1, wherein the arc center drive assembly further comprises a first and a second lift lever, each lift lever being interconnected with a respective one of the lift arms such that movement of the lift levers causes pivotal movement of the corresponding lift arm, the second ends of the vertical drive elements each being coupled to the respective lift arm by being coupled to the corresponding lift lever.

8. The elliptical exercise device of claim 1, wherein the lift end of each lift arm extends generally rearwardly and upwardly from its pivot end when at an upper end of its range of travel.

9. The elliptical exercise device of claim 8, wherein each lift arm is generally horizontal when at a lower end of its range of travel and each lift arm pivots through less than 90 degrees.

10. The elliptical exercise device of claim 1, wherein the surface of each of the foot support links that is engaged by the lift end of the respective lift arm is a lower surface, the lower surface being angled or curved downwardly away from a foot receiving surface of the foot receiving area of the respective foot support link.

11. The elliptical exercise device of claim 1, further comprising a first and a second horizontal drive element each having a first end coupled to the crank and a second end coupled to a respective one of the guide links such that rotation of the crank about the crank axis is operable via the horizontal drive elements to pivot the guide links relative to the frame and to thereby cause the foot receiving areas to move in a path of travel having a horizontal component of motion.

12. An elliptical exercise device, comprising:

a frame having an upper portion and a lower portion, the lower portion configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

an arc center drive assembly operable to raise and lower the foot receiving areas of the foot support links, the arc center drive assembly having a first and a second lift arm each having a pivot end pivotally connected to the lower portion of the frame and an opposite lift end, the lift end engaging a surface of a respective one of the foot support links such that pivoting of the lift arm causes the foot receiving area of the respective foot support link to raise or lower;

a crank supported on the frame for rotation about a crank axis;

a first and a second vertical drive element each having a first end coupled to the crank and a second end coupled to a respective one of the lift arms such that rotation of the crank about the crank axis is operable via the vertical drive elements to pivot the lift arms is about their respective pivot ends and to thereby raise and lower the foot receiving areas of the foot support links; and a first and a second horizontal drive element each having a first end coupled to the crank and a second end coupled to a respective one of the guide links such that rotation of the crank about the crank axis is operable via the horizontal drive elements to pivot the guide links relative to the frame and to thereby cause the foot receiving areas to move in a path of travel having a horizontal component of motion;

wherein the lift anus each pivot through less than 180 degrees.

13. The elliptical exercise device of claim 12, wherein the vertical drive elements are in tension in all rotational positions of the crank.

14. The elliptical exercise device of claim 12, wherein the vertical drive elements are each a rigid link.

15. The elliptical exercise device of claim 13, wherein the vertical drive elements are each a flexible element, the flexible elements being cables or belts.

16. The elliptical exercise device of claim 15, further comprising a first and a second forward pulley pivotally supported on the frame forward of the crank axis, the flexible elements each extending around a respective one of the forward pulleys.

17. The elliptical exercise device of claim 12, wherein the vertical drive elements are generally horizontal.

18. The elliptical exercise device of claim 12, wherein the arc center drive assembly further comprises a first and a second lift lever, each lift lever being interconnected with a respective one of the lift arms such that movement of the lift levers causes pivotal movement of the corresponding lift arm, the second ends of the vertical drive elements each being coupled to the respective lift arm by being coupled to the corresponding lift lever.

19. The elliptical exercise device of claim 12, wherein the lift end of each lift arm extends generally rearwardly and upwardly from its pivot end when at an upper end of its range of travel.

20. The elliptical exercise device of claim 19, wherein each lift arm is generally horizontal when at a lower end of its range of travel and each lift arm pivots through less than 90 degrees.

21. The elliptical exercise device of claim 12, wherein the surface of each of the foot support links that is engaged by the lift end of the respective lift arm is a lower surface, the lower surface being angled or curved downwardly away from a foot receiving surface of the foot receiving area of the respective foot support link.

* * * * *